US009968986B2

(12) United States Patent
Gutsche et al.

(10) Patent No.: US 9,968,986 B2
(45) Date of Patent: May 15, 2018

(54) THREAD ROLLING HEAD

(71) Applicant: LMT Fette Werkzeugtechnik GmbH & Co. KG, Schwarzenbek (DE)

(72) Inventors: Christian Gutsche, Hamburg (DE); Stefan Janke, Koberg (DE); Raphael Lienau, Hamburg (DE)

(73) Assignee: LMT Fette Werkzeugtechnik GmbH & Co. KG, Schwarzenbek (DE)

( * ) Notice: Subject to any disclaimer, the term of this patent is extended or adjusted under 35 U.S.C. 154(b) by 394 days.

(21) Appl. No.: 14/572,201

(22) Filed: Dec. 16, 2014

(65) Prior Publication Data

US 2015/0165512 A1 Jun. 18, 2015

(30) Foreign Application Priority Data

Dec. 17, 2013 (EP) ..... 13197739

(51) Int. Cl.
*B21H 3/04* (2006.01)

(52) U.S. Cl.
CPC ..... *B21H 3/046* (2013.01); *B21H 3/044* (2013.01); *B21H 3/042* (2013.01); *B21H 3/048* (2013.01)

(58) Field of Classification Search
CPC ..... B21H 3/04; B21H 3/042; B21H 3/044; B21H 3/046; B21H 3/048
USPC ... 72/102, 103, 104, 108, 120, 481.3, 481.4, 72/481.5, 481.6, 481.7, 481.8, 481.9
See application file for complete search history.

(56) References Cited

U.S. PATENT DOCUMENTS 2,651,224 A * 9/1953 Ferenc ..... B21H 3/044 72/104
2,909,087 A * 10/1959 Powell ..... B21H 3/046 72/100

(Continued)

FOREIGN PATENT DOCUMENTS

AT 184036 4/1955
DE 90 02 822 U1 7/1990

(Continued)

OTHER PUBLICATIONS

U.S. patent application filed concurrently herewith entitled "Thread Rolling Head" and claiming priority to DE 13 197 742.3.

*Primary Examiner* — Teresa M Ekiert
*Assistant Examiner* — Gregory Swiatocha
(74) *Attorney, Agent, or Firm* — Young Basile Hanlon & MacFarlane, P.C.

(57) ABSTRACT

A thread rolling head includes a bearing housing, in which at least two profile rollers, preferably at least three, are each rotatably mounted on an eccentric shaft. A shank is coupled to the housing, and adjacent profile rollers delimit an insertion section into which a workpiece can be longitudinally inserted. The bearing housing includes two housing parts rotatable relative to each other to change the spacing between the profile rollers. An adjustment element interacts with one of the two housing parts and can rotate about the longitudinal axis thereof. Rotation of the adjustment element in a first direction causes rotation of the two housing parts in a third rotational direction, while its rotation in the second direction causes rotation of the housing parts in a fourth rotational direction counter to the third rotational direction. A display apparatus displays a change of the spacing between the profile rollers.

14 Claims, 3 Drawing Sheets

(56) References Cited

U.S. PATENT DOCUMENTS

| | | | | | |
|---|---|---|---|---|---|
| 3,365,924 | A * | 1/1968 | Cummings | B21H 3/046 | 72/100 |
| 3,367,159 | A * | 2/1968 | Youtz | B21H 3/044 | 72/126 |
| 3,375,732 | A * | 4/1968 | Voeller | F16C 3/28 | 74/570.21 |
| 3,580,028 | A * | 5/1971 | Walters | B21D 15/04 | 72/100 |
| 3,972,213 | A * | 8/1976 | Habegger | B21H 3/046 | 470/83 |
| 5,568,743 | A * | 10/1996 | Oppelt | B21H 3/044 | 72/103 |
| 6,684,674 | B2 | 2/2004 | Focken | | |
| 2005/0210943 | A1* | 9/2005 | Allart | B21H 3/044 | 72/78 |

FOREIGN PATENT DOCUMENTS

| | | | | |
|---|---|---|---|---|
| DE | 44 30 184 | C2 | 1/1997 | |
| EP | 1 231 001 | A1 | 8/2002 | |
| GB | 841785 | A * | 7/1960 | B21H 3/046 |
| WO | 20051102557 | A2 | 11/2005 | |

* cited by examiner

THREAD ROLLING HEAD

CROSS-REFERENCE TO RELATED APPLICATION

This application claims priority to EP 13 197 739.9, filed Dec. 17, 2013, the content of which is incorporated herein in its entirety by reference.

FIELD OF THE DISCLOSURE

The disclosure relates in general to a thread rolling head.

BACKGROUND

Thread rolling heads can be, for example, axial thread rolling heads or radial thread rolling heads. They can have, for example, three profile rollers uniformly distributed about an insertion section. A workpiece, cylindrical for example, can be inserted in the longitudinal direction into the insertion section. With axial thread rolling heads, machining (that is, forming the threads) on the workpiece occurs in the course of insertion into the insertion section. With radial thread rolling heads, the profile rollers for machining are positioned radially onto the workpiece after the insertion of the workpiece. Generally, there is an opening mechanism with which the profile rollers can be displaced between a machining position and an open position, in which they are displaced radially outward. After the machining process, the rollers are moved into the open position, and the thread rolling head can be removed from the workpiece without collision.

For adapting to different workpieces to be machined, and also for precise adjustment, it is frequently necessary to adapt the cross-section of the insertion section in the machining position of the profile rollers by adjusting the spacing of the profile rollers to each other. Different solutions to this problem have been attempted. From German document DE 4430184 C2, for example, a bearing housing of an axial thread rolling head comprises two housing parts that can rotate relative to each other. The spacing of the profile rollers in the machining position can be changed by manually rotating the housing parts relative to each other. A gearing mechanism is provided between the housing parts that can rotate relative to each other, which translates the relative rotation between the housing parts into a corresponding change in the spacing of the profile rollers. It is possible to rotate the housing parts after loosening a clamp. A similar solution is attempted in International document WO 2005/102557 A2.

Radial displacement of profile rollers is shown in German document DE 9002822 U1.

BRIEF SUMMARY

German document DE 4430184 C2 and International document WO 2005/102557 A2 illustrate devices that make it possible to quickly change the profile roller spacing by manually rotating the housing parts. However, manual rotation often does not provide sufficient fine positioning of the profile rollers. The positioning of the profile rollers remains undefined. A further provided scale can lead to confusion because with different rolling head positions, there is positioning to a greater or lesser extent. There is also the danger that after manual rotation and in the course of subsequent clamping, there is an undesired rotation of the housing parts, and thus displacement of the profile rollers. The device described in German document DE 9002822 U1 is constructively elaborate and likewise does not attain a defined positioning in a sufficiently precise manner.

It has been proposed to perform an adjustment of the spacing of profile rollers using two threaded pins which each press from one side against a stop or similar, and thereby change the spacing of the profile rollers to each other. In such a design, however, it is disadvantageous that one threaded pin must always be loosened first and then retightened in order to be able to adjust with the other threaded pin in the other direction. Here again, no uniquely defined positioning is possible, and the constructive design is elaborate.

According to another similarly constructively elaborate design leading to large overall size, the profile rollers are arranged in conical holders, and are adjusted relative to each other by axially offsetting the conical holders. Here again, no defined positioning is realized but rather an adjustment that depends strongly on the respective worker. When a device allows only two profile rollers, the rollers may be arranged on a slide and can be moved towards or away from each other in the longitudinal direction, for example by screwing. This design is also constructively elaborate and suitable only for very specific uses, namely only with tools having two profile rollers arranged across from each other.

It is thus desirable to provide a thread rolling head in which a defined precise adjustment of the spacing of the profile rollers to each other is possible in a constructively simple manner even with tools having more than two profile rollers.

A thread rolling head described herein comprises a bearing housing, in which at least two profile rollers, and preferably at least three profile rollers, are each rotatably mounted on an eccentric shaft, and a shank coupled to the bearing housing, wherein the profile rollers between each other delimit an insertion section, into which a workpiece to be machined can be inserted in the longitudinal direction. The bearing housing comprises two housing parts that can rotate relative to each other, wherein a rotation of the housing parts relative to each other changes the spacing of the profile rollers to each other The thread rolling head further includes an adjustment element that is interacting with one of the housing parts and that can rotate in two directions of rotation about the longitudinal axis thereof. Rotation of the adjustment element in the first direction of rotation causes relative rotation of the housing parts with respect to each other in a first direction of rotation, and rotation of the adjustment element in the second direction of rotation causes relative rotation of the housing parts with respect to each other in a second direction of rotation counter to the first direction of rotation. A display apparatus can display a change of the spacing of the profile rollers relative to each other.

The thread rolling head can be an axial thread rolling head or a radial thread rolling head. It has at least two profile rollers, preferably three or more profile rollers. Adjacent profile rollers delimit an insertion section that is, for example cylindrical or tapering cone-shaped in the direction of insertion of a workpiece. The workpiece to be machined, a cylindrical workpiece for example, can be inserted in the longitudinal direction into the insertion section. A shank, also cylindrical in this example, is coupled in a conventional manner to the bearing housing of the thread rolling head. The shank can be movable in the axial direction relative to the bearing housing. The longitudinal axis of the insertion section can run, in particular, coaxially to the longitudinal axis of the shank. For inserting the cylindrical workpiece in the axial direction into the insertion section, an axial relative movement is necessary between the workpiece and the thread rolling head. For this purpose, the workpiece or the thread rolling head or both can be moved in the axial direction. With an axial thread rolling head, the machining (that is, the thread forming on the workpiece) occurs in the course of the insertion of the workpiece into the insertion section. Thus, in this case, the cross-section of the insertion section in the machining position of the profile rollers is smaller, at least in sections, than the cross-section of the workpiece. With a radial thread rolling head, after the axial insertion of the workpiece into the insertion section, there is a radial positioning movement of the profile rollers of the thread rolling head onto the workpiece, and thereby the workpiece is machined. The workpiece can be rotated for the machining, wherein the thread rolling head is arranged fixed against rotation. However, it is possible that the workpiece is arranged fixed against rotation, and the thread rolling head is rotated in the course of the machining.

The profile rollers are each mounted rotatably on an eccentric shaft, wherein the eccentric shafts are held in the bearing housing. As explained, the shank can be axially movable with respect to the bearing housing. Then the shank in a first axial relative position can interact, for example, by means of a dog clutch section with a corresponding dog clutch section of the bearing housing, whereby both parts are coupled in a rotationally fixed manner. Furthermore, a gearing mechanism can be provided between the shank and the eccentric shafts, and a spring element, for example a spiral spring, can be provided between the shank and the bearing housing such that in a second axial relative position of the shank with respect to the bearing housing, in which the dog clutch sections are disengaged, the spiral spring is tensioned with a rotation of the bearing housing in a first direction of rotation with respect to the shank, or respectively the tensioned spiral spring rotates the bearing housing relative to the shank in the second direction of rotation. Additional spring means can tension the shank and the bearing housing towards each other into the first relative position. In an example, mechanical switching means can be provided that, with contact to the workpiece, brings the shank and the bearing housing into the second relative position. In this manner, an opening and closing of the thread rolling head is possible by moving the profile rollers between the machining position thereof and a radially opened open position. In the open position, the cross-section of the insertion section is, in any case, greater than the cross-section of the workpiece such that the thread rolling head after machining can be removed from the workpiece without collision therewith.

The bearing housing further comprises two housing parts that can rotate relative to each other in particular about the longitudinal axis of the shank, or respectively of the insertion section, wherein a rotation of the housing parts relative to each other changes the spacing of the profile rollers to each other in the machining position. In the course of the rotation of the housing parts, rotatable relative to each other, the profile rollers are displaced with respect to the insertion section, in particular in the radial direction. The cross-section of the insertion section is thereby changed. In doing so, the profile rollers are each displaced in the same manner due to the relative rotation of the housing parts. In the case of three profile rollers, for example, the profile rollers remain uniformly distributed and concentrically arranged to the insertion section. Naturally, the longitudinal axes of the profile rollers can be slightly angled with respect to the longitudinal axis of the insertion section.

According to at least one embodiment of the invention, an adjustment element interacting with one of the housing parts, rotatable relative to each other, can be rotated in two opposing directions of rotation, for example by manually screwing in or out. A rotation of the adjustment element in a first direction causes a relative rotation of the housing parts with respect to each other in one direction, and a rotation of the adjustment element in a second direction causes a relative rotation of the housing parts with respect to each other in another direction. In particular, the adjustment element acts directly or indirectly on one of the relatively rotatable housing parts such that this housing part is rotated, whereas the other housing part is not rotated. Thereby it is possible to adjust the spacing of the profile rollers.

The adjustment element can be rotated forward and backward in a simple and defined manner, wherein in both directions there is in each case a corresponding relative rotation of the housing parts. Furthermore, a display apparatus may in each case display the change of the spacing of the profile rollers to each other caused by a relative rotation of the housing parts. The cooperation of the display apparatus with the adjustment element according to the teachings herein allows a defined precise adjustment of the profile rollers, in particular in the machining position. This is attained in a constructively simple and easily and reliably operable manner. The adjustment element according to the invention also reliably prevents a loosening or tightening of a clamp of the thread rolling head, for example, that leads to an undesired displacement of the profile roller position.

A gearing mechanism can be provided that changes the spacing of the profile rollers to each other with a relative rotation of the housing parts to each other. The gearing mechanism can be arranged between a spring housing and an intermediate plate of the thread rolling head. Alternatively, it can be arranged between the intermediate plate and the front plate. The gearing mechanism can comprise a center gear connected fixed against rotation to the shank, and at least two outer gears meshing with the center gear. In each case, an eccentric shaft is connected fixed against rotation to respectively one outer gear. In particular there are as many outer gears provided as profile rollers, or respectively eccentric shafts. The shank can furthermore be connected fixed against rotation to the spring housing such that a relative rotation between the spring housing and the intermediate plate also causes a relative rotation between the shank and the intermediate plate. Thereby, the center gear is rotated. The rotation of the center gear leads to a rotation of the outer gears. This in turn rotates the eccentric shafts, and thus changes spacing of the profile rollers to each other. After the machining of a workpiece, the shank, or respectively corresponding spring means, as explained above, can rotate in particular the center gear, and thus via the outer gears, rotate the eccentric shafts supporting the profile rollers, so that the profile rollers are moved out of the machining position into the open position and the thread rolling head can be removed from the workpiece.

According to a further design, the bearing housing has a front plate, and the first of the rotatable housing parts is an intermediate plate. The profile rollers together with the eccentric shafts rotatably supporting them are held between the front plate and the intermediate plate. The second of the rotatable housing parts can be a spring housing in which at least one spring element, for example a spiral spring, is arranged. Further, a plurality of spacing bolts may be arranged between the front plate and the intermediate plate, fastened to the front plate and extending with an end section through the intermediate plate and the front plate in each case. In each case a thread is formed on the end sections of the distance bolts, and lock nuts are screwed onto the threads from the side of the spring housing facing away from the front plate.

The front plate and the intermediate plate form a roller cage, in which the profile rollers are captured. The spring housing holds spring means, which pretension the shank and the bearing housing on each other into the first relative position, as explained in principle above. For example, in the case of three profile rollers, three distance bolts can be provided arranged regularly between the profile rollers. The distance bolts hold the front plate at a distance from the intermediate plate and are screwed to the front plate, for example, from the front side of the front plate facing away from the intermediate plate. On the other end thereof, lock nuts are screwed onto the end sections provided with a thread. The bearing housing is thereby held securely together. The lock nuts must be loosened in order to displace the adjustment element, and thus the spacing of the profile rollers. After loosening the lock nuts, however, the spacing of the profile rollers cannot be displaced inadvertently due to the adjustment element provided according to the teachings herein. The lock nuts represent an additional safety against unintended displacement of the spacing of the profile rollers. The adjustment element cannot be moved axially in the tightened state of the lock nuts.

According to a further design, the adjustment element is a threaded spindle rotatable about its longitudinal axis and fixed in the axial direction to the first or second housing part. Furthermore, a slide block has a thread with which the threaded spindle is in engagement such that the slide block moves axially forward or backward on the threaded spindle in the case of a rotation of the threaded spindle in the first or the second direction of rotation, thereby causing relative rotation of the housing parts in the first or second direction of rotation.

Furthermore, one of the distance bolts may be accommodated radially movable in a receiving opening of the slide block so that an axial movement of the slide block causes an arc-shaped movement of the distance bolt guided in the receiving opening of the slide block, and thereby rotates the intermediate plate relative to the spring housing or the spring housing relative to the intermediate plate. The accommodation of the slide block can be a recess that is open on one side, in particular open in the radial direction. However, the receiving opening of the slide block can also be an elongated hole, the longitudinal direction of which runs transverse to the axial movement direction of the slide block. With this design, the desired positioning, and thus the precise adjustment of the profile roller position, occurs via a rotation of the threaded spindle, whereby the slide block is moved axially on the threaded spindle. The distance bolt is guided in an elongated hole or an open recess of the slide block so that it moves with an axial movement of the slide block, and simultaneously moves radially in the elongated hole or the open recess of the slide block. The receiving opening of the slide block allows a radial movement of the distance bolt so that on the whole, it can describe an arc-shaped movement.

If necessary or desirable, additionally provided distance bolts can be guided, for example, in arc-shaped elongated holes of the intermediate plate or the spring housing. In the respective other housing part of intermediate plate and spring housing, the distance bolts can be placed through simple, for example circular, bore holes.

The threaded spindle can be rotated through an access opening in one of the housing parts rotatable relative to each other, preferably in the spring housing, using a screwing tool. The access opening can be a lateral access opening, for example a lateral bore hole, through which the threaded spindle can be screwed in or out using a screwing tool, for displacing the profile rollers. A display can be provided at the access opening that displays in which screw direction the spacing of the profile rollers is increased (for example a +) and in which the screw direction the spacing of the profile rollers is decreased (for example a −).

According to a further design, the adjustment element is a threaded pin rotatable about its longitudinal axis, which is screwed into a thread formed in the intermediate plate or the spring housing such that the threaded pin is movable in the axial direction by a rotation about its longitudinal axis. The threaded pin has a receiving opening, and one of the distance bolts is accommodated radially movable in the receiving opening of the threaded pin such that an axial movement of the threaded pin causes an arc-shaped movement of the distance bolt guided in the receiving opening of the threaded pin, and thereby rotates the intermediate plate relative to the spring housing or the spring housing relative to the intermediate plate. The receiving opening of the threaded pin can in turn be a recess open to one side, in particular a recess open in the radial direction. However, it is also possible that the receiving opening of the threaded pin is an elongated hole whose longitudinal direction extends transverse to the axial movement direction of the threaded pin, and thus forms an elongated hole running in the radial direction.

The function of the precise adjustment in this case is substantially analogous to the function described above with the provision of a threaded spindle and a slide block that is axially movable thereupon. The threaded pin can be rotated in both directions and thereby, unlike the threaded spindle, can also be moved forward and backward in the axial direction in the thread of the respective housing part. In this case the receiving opening is formed directly on the threaded pin such that an axial movement of the threaded pin in turn causes a relative rotation of the housing parts in the first or second direction of rotation. Again, if necessary or desirable, further provided distance bolts can be guided in, for example, arc-shaped elongated holes of the intermediate plate or the spring housing. The distance bolts can then in turn be guided through simple bore holes, for example circular bore holes, in the respective other housing part of intermediate plate and spring housing.

According to a further design, the adjustment element is an adjusting worm gear provided with external teeth, rotatable about the longitudinal axis thereof, and fixed to the first or second housing part in the axial direction. The external teeth of the adjusting worm gear engage with adjusting teeth formed on the respective other of the first or second housing part such that a rotation of the adjusting worm gear in the first or second direction causes a relative rotation of the housing parts in the first or second direction. The adjusting worm gear has external teeth and can be arranged, in an example, rotatable about the longitudinal axis in the spring housing and fixed in the axial direction. If the adjusting worm gear is rotated, in this example the intermediate plate likewise rotates due to the adjusting teeth formed therein, meshing with the external teeth of the adjusting worm gear.

The threaded pin or the adjusting worm gear can in turn be rotated through an access opening in one of the housing parts rotatable relative to each other, preferably in the spring housing, using a screwing tool. Again, it can be in particular a lateral access opening, for example, a lateral bore hole, through which the threaded pin or the adjusting worm gear can be screwed in or out using a screwing tool. Again, a display can be provided on the access opening that shows in which screw direction the spacing of the profile rollers is increased, or respectively decreased.

In this description, the adjustment elements according to the various embodiments rotate about the longitudinal axes thereof, in particular the longitudinal axes of the threaded spindle, the threaded pin or the adjusting worm gear. These longitudinal axes may run tangential to an imaginary circle about the longitudinal axis of the shank, or respectively of the insertion section.

According to a further design, the display apparatus may comprise a scale having scale marks arranged on one of the housing parts rotatable relative to each other and a display element interacting with the scale marks, preferably a display mark or display point on the other of the housing parts rotatable relative to each other. Furthermore, the scale can be divided non-uniformly such that with a relative rotation of the housing parts by two arbitrarily adjacent scale marks in each case there is an equal distance change of the profile rollers to each other. Because of the eccentric shafts, a significant and defined scale is attained by non-uniform scale division so that the same displacement path of the profile rollers is always present from one scale mark to the next. However, other display apparatuses are also conceivable, for example, a numerical display apparatus (e.g., a dial gauge), a meter or a digital display of the change of the profile roller spacing.

In an assembled starting state of the housing parts rotatable relative to each other, the display apparatus may show a zero position of the profile rollers. A predefined assembly position, desirably exactly one, results in the complete adjustment range for the profile rollers. From this predefined starting position, the profile rollers can be moved together or moved apart in the position thereof relative to the longitudinal axis of the insertion section. Thereby a uniquely defined display of the profile roller spacing, or respectively the change thereof, is attained. Other designs make three or more different rotation positions possible for the assembly in order to maximize the adjustment range of the threaded rolling head. However, no defined scaling is possible with such designs, as is available according to the teachings herein.

These and other embodiments of the invention are explained in the following in more detail using the drawings.

BRIEF DESCRIPTION OF THE DRAWINGS

The description herein makes reference to the accompanying drawings wherein like reference numerals refer to like parts throughout the several views unless otherwise noted, and wherein.

DETAILED DESCRIPTION

Figure 1:
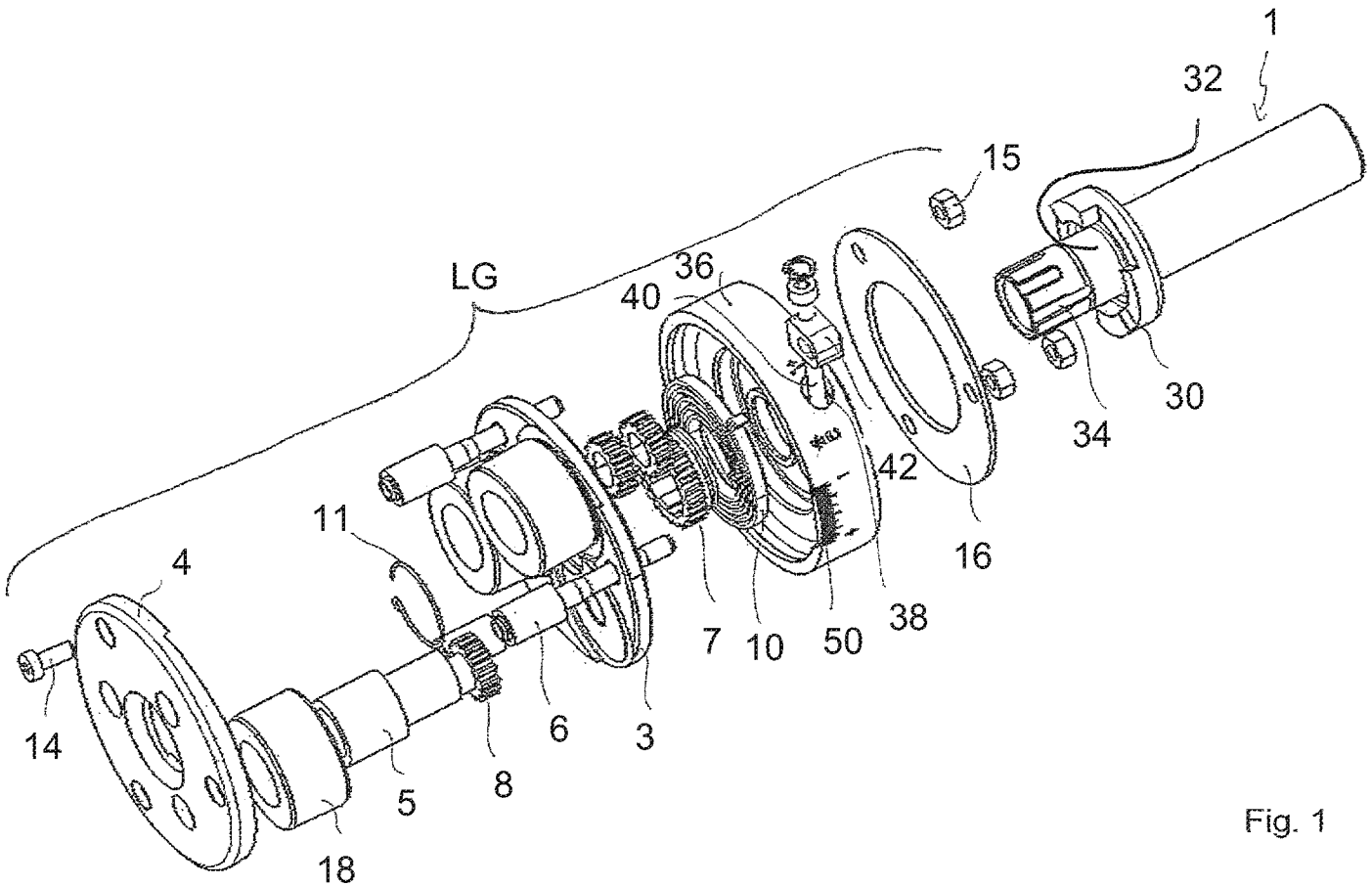
FIG. 1 is a perspective, exploded view of a thread rolling head according to an embodiment of the invention.

FIG. 1 shows a thread rolling head according to an embodiment of the invention, here an axial thread rolling head. It has a bearing housing LG and a shank 1. The shank 1 can be mounted, for example, in a numerically-controlled tool machine. It has a coupling section 30 and a cylindrical bearing section 32. In addition, it has a splined section 34. In the example shown there are three profile rollers 18 in the bearing housing, each mounted on an eccentric shaft 5. The ends of the eccentric shafts 5 are seated in corresponding bore holes of a front plate 4 and an intermediate plate 3. The two plates 3, 4 are held separated by distance bolts 6. The distance bolts 6 are screwed to the front plate 4 using screws 14. A threaded opposing end section of the distance bolts 6 extends through corresponding bore holes in the intermediate plate 3.

The profile rollers 18 are mounted rotatably on the eccentric shafts 5, which are flattened on the rear ends, wherein the flattened end in turn interacts with correspondingly designed boreholes of outer gears 8. The outer gears 8 part mesh with a center gear 7. The center gear 7 is mounted on the splined section 34 of the shank 1. When the center gear 7 rotates, the outer gears 8 and thus the eccentric shafts 5 rotate. Rotation of the eccentric shafts 5 leads to a change of the mutual spacing of the profile rollers 18. For thread forming, the profile rollers 18 require a preset spacing from each other in a machining position. This must be enlarged in an open position such that the machined workpiece can be withdrawn from between the rollers 18.

A spring housing 36 sits with a center bore hole on the bearing section 32 of the shank 1. It has a dog clutch section (not shown in FIG. 1), which interacts with the coupling, or dog clutch, section 30 of the shank 1. A spiral spring 10 whose outer end interacts with a slit within the spring housing 36 is arranged in the spring housing 36. The inner end of the spiral spring 10 is connected to the bearing section 32 of the shank 1.

A spring ring 11 secures the axial bearing of the bearing housing on the shank 1. The end sections of the distance bolts 6 extend through arc-shaped elongated holes of the spring housing 36 and through bore holes of a locking washer 16. The spring housing 36 is securely screwed against the intermediate plate 3 using lock nuts 15 screwed onto the threads of the end sections of the distance bolts 6, wherein the relative rotational position between spring housing 36 and intermediate plate 3 can be previously adjusted manually. A scale is provided on the spring housing 36 for this purpose.

If the dog clutch sections are in engagement, the profile rollers 18 have a preset spacing to each other, namely in the machining position. The spiral spring 10 is tensioned. If a thread is formed in a workpiece that is inserted in the insertion section between adjacent profile rollers 18, the workpiece moves rotatingly into the thread rolling head, or respectively the bearing housing, until the feed motion of the shank 1 together with the bearing housing LG is terminated by a stop (not shown), and the bearing housing LG itself is moved further due to the described feed motion. As a result, the claws of the dog clutch are disengaged and the spring housing 36 and thus the bearing housing LG perform a rotation due to the spring action of the spiral spring 10. This latter rotation can occur only over a predefined angle of rotation due to the construction of the dog clutch. This relative rotation of shank 1 and bearing housing LG causes, as described, a rotation of the eccentric shafts 5 such that the profile rollers 18 move into the open position thereof and the thread rolling head is opened. The workpiece can then be removed from the thread rolling head.

If the thread rolling head is to be closed again, the spring housing 36 must be rotated in the opposite direction via the shank 1 until the dog clutch engages again. Because the bearing housing, with the described opening movement, was axially removed from the shank 1, a tensile force was also exerted on the spiral spring 10. The dog clutch sections are brought into engagement again using this tensile force. With this, the profile rollers 18 are again located in the machining position. Thusly, the thread rolling head is closed for a new machining process.

Exemplary embodiments of a precise adjustment of the spacing of the profile rollers 18 to each other in the machining position thereof are explained using FIGS. 2 to 7. Here, the spring housing 36 of the thread rolling head according to FIG. 1 is shown in particular in FIGS. 2 to 4. The gearing mechanism of center gear 7 and outer gears 8 may also be arranged between the intermediate plate 3 and the front plate 4.

Figure 2:
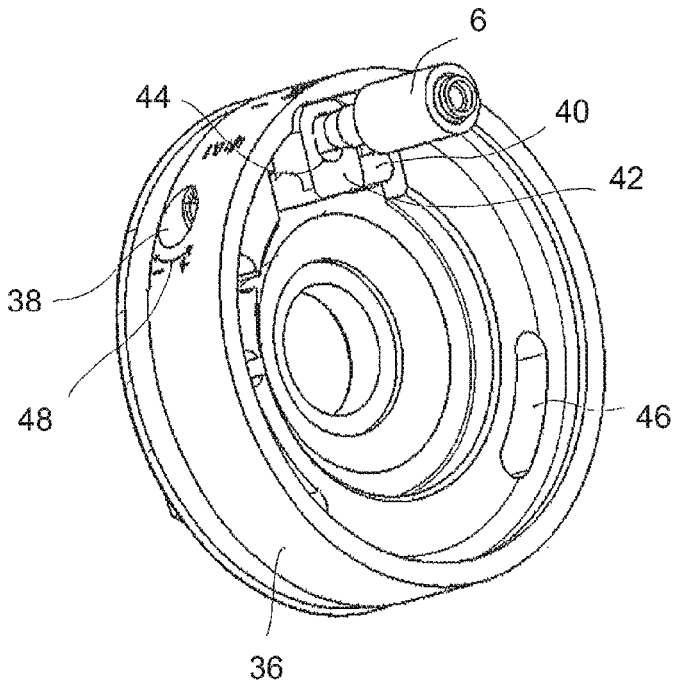
FIG. 2 is a perspective view of a spring housing of the thread rolling head of FIG. 1.
Figure 3:
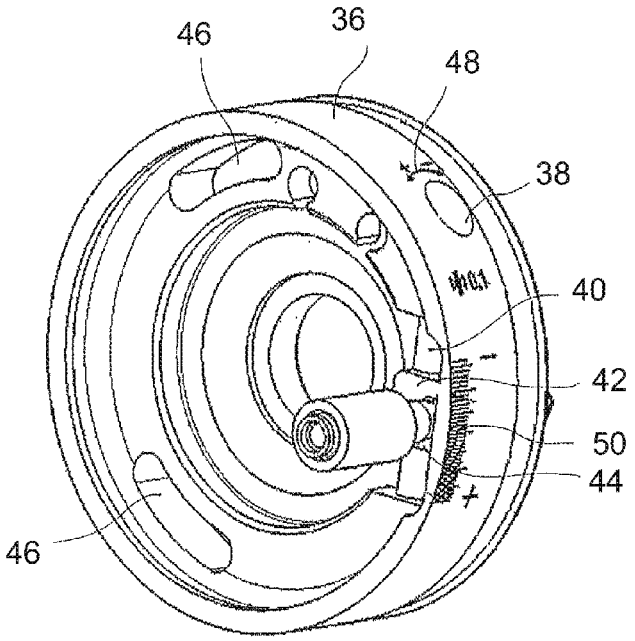
FIG. 3 is a further perspective view of the spring housing of FIG. 2.

FIG. 2 shows one of the three distance bolts 6 of the thread rolling head as an example. A lateral access opening 38 of the spring housing 36 can be seen in FIGS. 2 and 3, through which a threaded spindle 40 can be rotated in a first or second direction of rotation. The threaded spindle 40 is rotatably mounted in an axially fixed position within the spring housing 36. A slide block 42 is arranged on the threaded spindle 40. A thread is formed on the slide block 42 that is in engagement with the thread of the threaded spindle 40 such that the slide block 42 is moved axially forward or backward with respect to the longitudinal direction of the threaded spindle 40 with rotation of the threaded spindle 40 in a first or second direction of rotation. The slide block 42 has an elongated hole 44 running in the radial direction in which the distance bolt 6 is guided radially movable. The other two distance bolts 6, which for reasons of clarity are not shown in FIGS. 2 and 3, are guided in the arc-shaped elongated holes 46 formed in the spring housing 36.

In this arrangement, if the threaded spindle 40 is screwed in or out via the access opening 38, the slide block 42 moves axially forward or backward and the distance bolt 6 moves with it such that, in the course of its axial movement, the slide block 42 simultaneously moves radially in the elongated hole 44, and thus describes in total an arc-shaped movement, which corresponds to the arc-shape of the arc-shaped elongated holes 46 in the spring housing 36. In this way, the intermediate plate 3 can be rotated with respect to the spring housing 36 such that the spacing of the profile rollers 18 to each other is adjusted in a defined and precise manner using the gearing mechanism composed of the center gear 7 and outer gears 8.

Here, on one side in the region of the access opening 38, a display 48 is provided that shows, using a + or − sign, the screw direction for increasing or decreasing the spacing of the profile rollers 18. Furthermore, a display apparatus on the spring housing 36 can be seen in FIG. 3. In this example, the display apparatus comprises a scale 50 with non-uniform scale mark divisions. A corresponding numerical mark is provided on the intermediate plate 3 of the thread rolling head. The scale 50 is divided non-uniformly so that there is always the same spacing change of the profile rollers 18 between any two adjacent scale marks.

Figure 4:
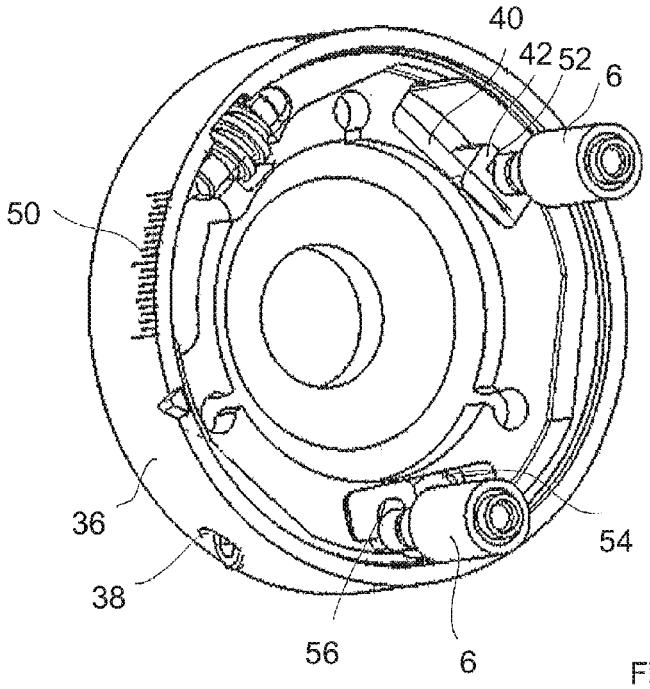
FIG. 4 is a perspective view of a spring housing of the thread rolling head of FIG. 1 used to explain alternative embodiments of the invention.

Further embodiments of the invention are explained as examples using FIG. 4. Although three different embodiments are shown in the spring housing 36, actually in each case only one of the displacement possibilities is used, whereas at the other positions for example, the distance bolts 6 are guided in arc-shaped elongated holes 46. The embodiment shown in FIG. 4 on the top right side corresponds largely to that shown in FIGS. 2 and 3, with the difference that the slide block 42 in this case has no radial elongated hole for accommodating the distance bolt 6 but rather has a recess 52 that is open outward on one side in the radial direction. This is shown in an enlargement in FIG. 6. The function is identical to that of the embodiment explained in FIGS. 2 and 3.

Figure 7:
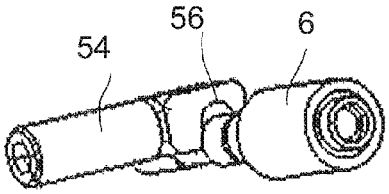
FIG. 7 is an enlarged detail view of an adjustment element according to yet another embodiment of the invention.

The bottom of FIG. 4 shows an embodiment that is shown enlarged in FIG. 7. In this case, a threaded pin 54 that can be screwed in or out via a lateral access opening 38 is guided axially movable in an internal thread of the spring housing 36. The threaded pin 54, on the end thereof facing away from the access opening 38, has a receiving opening 56. In this example, the receiving opening 56 is a recess opened outward in the radial direction. It could, however, be an elongated hole running in the radial direction. The distance bolt 6 with the end section thereof is in turn guided movable in the radial direction in the receiving opening 56. The function of this embodiment again corresponds largely to that of the embodiment shown in FIGS. 2 and 3, with the difference that in this case the threaded pin 54 itself moves in the axial direction, and via the receiving opening 56 thereof, causes the movement of the distance bolt 6 and thereby relative rotation between the spring housing 36 and the intermediate plate 3.

Figure 5:
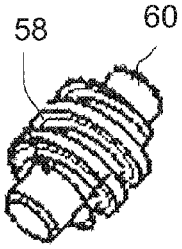
FIG. 5 is an enlarged detail view of an adjustment element according to an embodiment of the invention.
Figure 6:
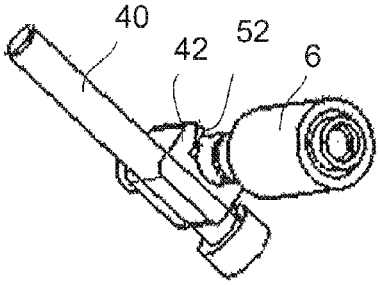
FIG. 6 is an enlarged detail view of an adjustment element according to another embodiment of the invention.

FIG. 4 on the upper left side shows another embodiment that is shown in an enlarged detail in FIG. 5. In this case, an adjusting worm gear 60 is provided with external teeth 58 that in turn can be rotated in both directions of rotation through a lateral access opening (not shown in FIG. 4). The adjusting worm gear 60 is held in the spring housing 36 in a fixed position in the axial direction and interacts with teeth formed on the intermediate plate 3. Thereby, the rotation of the adjusting worm gear 60 in the first or second direction of rotation causes rotation of the intermediate plate 3 relative to the spring housing 36 in the first or second direction of rotation.

What is claimed is:

1. A thread rolling head, comprising:

a bearing housing for at least two profile rollers, each rotatably mounted on a respective eccentric shaft; and a shank coupled to the bearing housing; wherein:

adjacent rollers of the at least two profile rollers delimit an insertion section into which a workpiece to be machined can be inserted in a longitudinal direction defined by a rotational axis of the shank;

the bearing housing comprises two housing parts that can rotate relative to each other;

rotation of the two housing parts relative to each other changes spacing between the at least two profile rollers;

an adjustment element interacts with one of the two housing parts and is rotatable in two directions of rotation about a longitudinal axis thereof, the two directions including a first direction of rotation and a second direction of rotation;

a rotation of the adjustment element in the first direction of rotation causes relative rotation of the two housing parts to each other in a third direction of rotation;

a rotation of the adjustment element in the second direction of rotation causes relative rotation of the two housing parts to each other in a fourth direction of rotation counter to the third direction of rotation; and a display apparatus displays a change of the spacing between the at least two profile rollers, and wherein the adjustment element is a threaded spindle rotatable about a longitudinal axis thereof and fixed in an axial direction relative to the longitudinal axis on one of the two housing parts.

2. The thread rolling head according to claim 1, further comprising:

a gearing mechanism that changes the spacing between the at least two profile rollers with relative rotation of the two housing parts with respect to each other.

3. The thread rolling head according to claim 2, wherein:

the gearing mechanism comprises a center gear fixed against rotation to the shank and at least two outer gears meshing with the center gear; and each eccentric shaft is fixed against rotation to respectively one outer gear of the at least two outer gears.

4. The thread rolling head according to claim 1, wherein:

the bearing housing has a front plate;

a first housing part of the two housing parts is an intermediate plate; and the at least two profile rollers, together with the eccentric shafts bearing them rotatably, are held between the front plate and the intermediate plate.

5. The thread rolling head according to claim 4, wherein a second housing part of the two housing parts is a spring housing in which at least one spring element is arranged.

6. The thread rolling head according to claim 5, wherein:

a plurality of distance bolts is arranged between the front plate and the intermediate plate, each distance bolt fastened to the front plate and extending with an end section through the intermediate plate and the spring housing and each having a thread formed at the end section; and a respective lock nut is screwed onto each thread from a side of the spring housing facing away from the front plate.

7. The thread rolling head according to claim 6, further comprising:

a slide block having a thread that engages with the threaded spindle such that, with rotation of the threaded spindle in the first direction of rotation or the second direction of rotation, the slide block moves axially forward or backward on the threaded spindle to thereby cause relative rotation of the two housing parts in the third direction of rotation or the fourth direction of rotation; and wherein:

one distance bolt of the plurality of distance bolts is accommodated radially movable in a receiving opening of the slide block such that axial movement of the slide block causes arc- shaped movement of the one distance bolt guided in the receiving opening, and thereby rotates the intermediate plate relative to the spring housing or rotates the spring housing relative to the intermediate plate.

8. The thread rolling head according to claim 7, wherein the receiving opening of the slide block is one of:

a recess open on one side; or an elongated hole, a longitudinal direction of which runs transverse to a direction of the axial movement of the slide block.

9. The thread rolling head according to claim 1, further comprising:

a slide block having a thread that engages with the threaded spindle such that, with rotation of the threaded spindle in the first direction of rotation or the second direction of rotation, the slide block moves axially forward or backward on the threaded spindle to thereby cause relative rotation of the two housing parts in the third direction of rotation or the fourth direction of rotation.

10. The thread rolling head according to claim 9, wherein the threaded spindle is rotatable through an access opening in one of the two housing parts using a screwing tool.

11. The thread rolling head according to claim 1, wherein the display apparatus comprises a scale having scale marks arranged on one of the two housing parts and a display element interacting with the scale marks on the other of the two housing parts.

12. The thread rolling head according to claim 11, wherein the scale is non-uniformly divided such that with relative rotation of the two housing parts by any two adjacent scale marks there is a uniform change in spacing of the at least two profile rollers.

13. The thread rolling head according to claim 1, wherein the display apparatus displays a zero position of the at least two profile rollers in an assembled starting state of the two housing parts.

14. The thread rolling head according to claim 1, wherein:

the one of the two housing parts is a first housing part, the two housing parts including a second housing part;

the rotation of the adjustment element in the first direction of rotation causes relative rotation of the two housing parts to each other in the third direction of rotation by rotating the first housing part in the third direction while the second housing part is not rotated; and the rotation of the adjustment element in the second direction of rotation causes relative rotation of the two housing parts to each other in the fourth direction of rotation counter to the third direction of rotation by rotating the first housing part in the fourth direction while the second housing part is not rotated.

* * * * *